US008134514B2

(12) United States Patent
Yamaguchi et al.

(10) Patent No.: US 8,134,514 B2
(45) Date of Patent: Mar. 13, 2012

(54) COAXIAL LINE SLOT ARRAY ANTENNA AND METHOD FOR MANUFACTURING THE SAME

(75) Inventors: Satoshi Yamaguchi, Chiyoda-ku (JP); Yukihiro Tahara, Chiyoda-ku (JP); Kazushi Nishizawa, Chiyoda-ku (JP); Hiroaki Miyashita, Chiyoda-ku (JP); Hideyuki Oohashi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 411 days.

(21) Appl. No.: 12/447,916

(22) PCT Filed: Nov. 2, 2007

(86) PCT No.: PCT/JP2007/071380

§ 371 (c)(1),
(2), (4) Date: Apr. 30, 2009

(87) PCT Pub. No.: WO2008/065852

PCT Pub. Date: Jun. 5, 2008

(65) Prior Publication Data

US 2010/0001916 A1 Jan. 7, 2010

(30) Foreign Application Priority Data

Dec. 1, 2006 (WO) ..... PCT/JP2006/324109

(51) Int. Cl.
*H01Q 13/10* (2006.01)

(52) U.S. Cl. ..... 343/770; 343/771

(58) Field of Classification Search ..... 343/767, 343/768, 770, 771

See application file for complete search history.

(56) References Cited

U.S. PATENT DOCUMENTS

| | | | | |
|---|---|---|---|---|
| 2,840,818 | A * | 6/1958 | Reed et al. | 343/770 |
| 3,696,433 | A * | 10/1972 | Killion et al. | 343/770 |
| 3,729,740 | A * | 4/1973 | Nakahara et al. | 343/713 |
| 5,019,831 | A | 5/1991 | Yee et al. | |
| 5,369,414 | A | 11/1994 | Yee et al. | |
| 5,414,394 | A | 5/1995 | Gamand et al. | |
| 5,458,774 | A | 10/1995 | Mannapperuma | |
| 5,929,821 | A | 7/1999 | Goldstein et al. | |

(Continued)

FOREIGN PATENT DOCUMENTS

EP 0 209 220 A1 1/1987

(Continued)

OTHER PUBLICATIONS

Korean Office Action issued Feb. 18, 2011, in Patent Application No. 10-2009-7012003.

(Continued)

*Primary Examiner* — Hoang V Nguyen

(74) *Attorney, Agent, or Firm* — Oblon, Spivak, McClelland, Maier & Neustadt, L.L.P.

(57) ABSTRACT

A planar antenna including slot arrays configured to set a narrow interval between elements so as to perform beam scanning in a wide angle range while keeping low loss and low profile. The planar antenna includes: a coaxial line including an inner conductor, an outer conductor provided so as to surround a circumference of the inner conductor, and both ends short-circuited; a feeding mechanism for exciting the coaxial line; and a plurality of slots formed on the outer conductor with a certain angle with respect to a tube direction of the coaxial line and having approximately a resonance length.

12 Claims, 7 Drawing Sheets

U.S. PATENT DOCUMENTS

| | | | |
|---|---|---|---|
| 2006/0082426 | A1 | 4/2006 | Lo Hine Tong et al. |

FOREIGN PATENT DOCUMENTS

| | | |
|---|---|---|
| JP | 48 71951 | 9/1973 |
| JP | 62 30409 | 2/1987 |
| JP | 62 210704 | 9/1987 |
| JP | 63 260302 | 10/1988 |
| JP | 64 29004 | 1/1989 |
| JP | 64-29004 | 1/1989 |
| JP | 1 170202 | 7/1989 |
| JP | 3 119803 | 5/1991 |
| JP | 3 159401 | 7/1991 |
| JP | 6 283914 | 10/1994 |
| JP | 9-270633 | 10/1997 |
| JP | 2000 209024 | 7/2000 |
| JP | 2001 320228 | 11/2001 |
| JP | 2005 204344 | 7/2005 |
| JP | 2006 513654 | 4/2006 |

OTHER PUBLICATIONS

Office Action issued Oct. 11, 2011, in Japanese Patent Application No. 2008-546923.

* cited by examiner

COAXIAL LINE SLOT ARRAY ANTENNA AND METHOD FOR MANUFACTURING THE SAME

TECHNICAL FIELD

The present invention relates to a coaxial line slot array antenna formed of a plurality of slots in a coaxial line, and to a method of manufacturing the same.

BACKGROUND ART

As an antenna system related to a coaxial line slot array antenna, there is generally known a waveguide slot array antenna (for example, see Patent Document 1). In this waveguide slot array antenna, a waveguide, a short-circuit plate for short-circuiting both ends of the waveguide, and slots provided in a wide wall surface of the waveguide are combined to form a sub-array. There is provided a feed circuit as feeding means for the sub-arrays, and the respective sub-arrays and the feed circuit provided to the sub-arrays are combined to form a waveguide slot array type planar array antenna.

This antenna is uniformly excited when an input signal is uniformly transmitted to the feed circuit provided to the respective sub-arrays through a signal path. In a waveguide slot array which is a sub-array unit, the both ends of the waveguide are short-circuited by the short-circuit plate, and its length is set so that a standing wave propagates through the guide at a frequency to be used. The slots are set to have a length of substantially a half-wavelength, and are formed at desired intervals corresponding to standing wave excitation to be uniformly excited. Accordingly, the slots provided in the planar antenna are all uniformly excited, to thereby achieve high-gain radiation characteristics.

Further, there is provided means for performing phase control, and hence beam scanning can be performed. It should be noted that the reason why directions of the slots alternately differ is that the slots are formed at ½ λg (λg is a guide wavelength of the waveguide) interval on a tube axis. Further, depending on a polarized wave to be used, for example, the antenna may be used as one of a waveguide shunt slot array type (for example, see Patent Document 2).

It should be noted that, as a feature of the waveguide slot array antenna, in the case where the waveguide for exciting the slots is assumed to be a transmission line, first, loss is extremely lower compared with other line such as a microstrip line or a suspended line.

As an example of a coaxial line used for feeding, there is one in which one end of a probe is inserted into the coaxial line, and an element antenna is connected to another end thereof, to thereby perform feeding to the antenna (for example, see Patent Document 3). However, use of the probe complicates a structure and makes adjustment of a probe length difficult.

Patent Document 1: JP 62-210704 A
Patent Document 2: JP 2005-204344 A
Patent Document 3: JP 2000-209024 A

DISCLOSURE OF THE INVENTION

Problems to be solved by the Invention

In the waveguide slot array antenna, as described above, the slots are generally formed in the wide wall surface of the waveguide. Here, a size of a cross-section of the waveguide is determined by a frequency to be used, and normally, intervals on a wider inner surface thereof is set to be larger than a half-wavelength of a cut-off frequency. For this reason, the size of the cross-section is larger than a half-wavelength of the frequency to be used. Further, in the case of arraying, a wall thickness with an adjacent waveguide is also taken into consideration, whereby intervals between elements inevitably become larger than the above-mentioned value.

Incidentally, in the array antenna, when beam scanning is performed at a wide angle, for example, in ±60 degree range, intervals of the elements need to be set to approximately a half-wavelength. Therefore, it is difficult to perform beam scanning at a wide angle in the planar array antenna in which the slots are provided in the wide wall surface of the waveguide.

In order to solve this problem, there is proposed a waveguide slot array in which the slots are provided in a narrow wall surface of the waveguide. Taking a standard waveguide as an example, the narrow wall surface has approximately a half of a width of a wide wall surface, whereby intervals between the elements can be set to be narrower compared with the case of the wide wall surface. However, the waveguide needs to be erected to form the planar array antenna, leading to a problem that an antenna size (height) becomes large.

Moreover, it is conceivable that the waveguide is filled with a dielectric to reduce a cross-section size of the waveguide due to an effect of shortening a guide wavelength. In this case, waveguide performance depends on a characteristic of a dielectric material, and a manufacturing method in which dielectric filling is taken into consideration is complicated. Accordingly, considering mass productivity, it cannot be regarded as an appropriate method.

Further, it is also conceivable that a ridge waveguide is used to shorten the size of the wide wall surface. However, when a ridge is provided in the waveguide, and the structure becomes complicated, leading to a problem of manufacturability as in the case of dielectric filling.

The present invention has been made to solve the problems as described above, and therefore an object thereof is to provide a coaxial line slot array antenna and a method of manufacturing the same, which forms a planar antenna with slot arrays, capable of setting a narrow interval between elements so as to perform beam scanning in a wide angle range while keeping low loss and low profile.

Means for Solving the Problems

A coaxial line slot array antenna according to the present invention includes: a coaxial line including an inner conductor, an outer conductor provided so as to surround a circumference of the inner conductor, and both ends short-circuited; feeding means for exciting the coaxial line; and a plurality of slots which are formed on the outer conductor with a certain angle with respect to a tube axis direction of the coaxial line and have approximately a resonance length.

Further, according to the present invention, there is provided a method of manufacturing a coaxial line slot array antenna, the coaxial line slot array antenna being formed by: a square coaxial line including an inner conductor, an outer conductor provided so as to surround a circumference of the inner conductor, and both ends short-circuited; a plurality of slots formed in an appropriate side surface of the outer conductor, which is parallel to a tube axis direction of the square coaxial line; and feeding means for exciting the square coaxial line, the square coaxial line, the plurality of slots, and the feeding means forming a single sub-array, a plurality of the sub-arrays being arranged on a plane to form a two-dimensional array antenna, the method including: individually cutting a plurality of metal conductor plates including respective plate-like portions divided and sliced so as to be parallel to the tube axis direction of the square coaxial line and also parallel to the side surface of the outer conductor including the plurality of slots formed therein; and laminating the plurality of metal conductor plates in which the respective portions are cut by contact bonding.

EFFECTS OF THE INVENTION

According to the present invention, the planar antenna formed with slot arrays capable of setting a narrow interval between elements so as to perform beam scanning in a wide angle range can be formed while keeping low loss and low profile.

BEST MODE FOR CARRYING OUT THE INVENTION

In embodiments described below, an antenna structure applicable to transmission and reception is described.

First Embodiment

Figure 1:
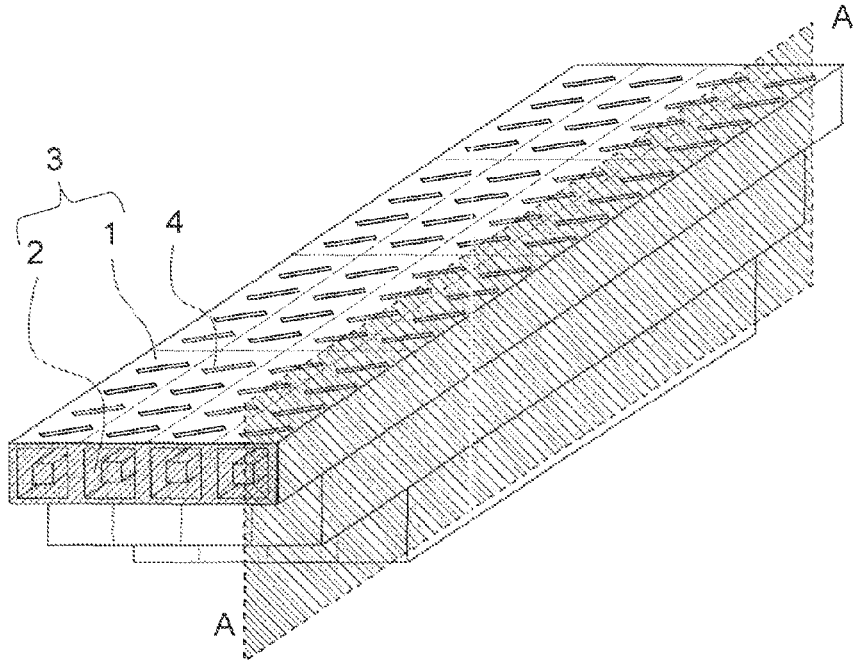
FIG. 1 is a perspective view illustrating a structure of a coaxial line slot array antenna according to a first embodiment of the present invention.

FIG. 1 is a perspective view illustrating a structure of a coaxial line slot array antenna according to a first embodiment of the present invention. In FIG. 1, a coaxial line 3 formed of a square coaxial line is formed of an outer conductor 1 and an inner conductor 2, and slots 4 are provided on a wall surface of the outer conductor 1, which forms a radiation surface.

Figure 2:
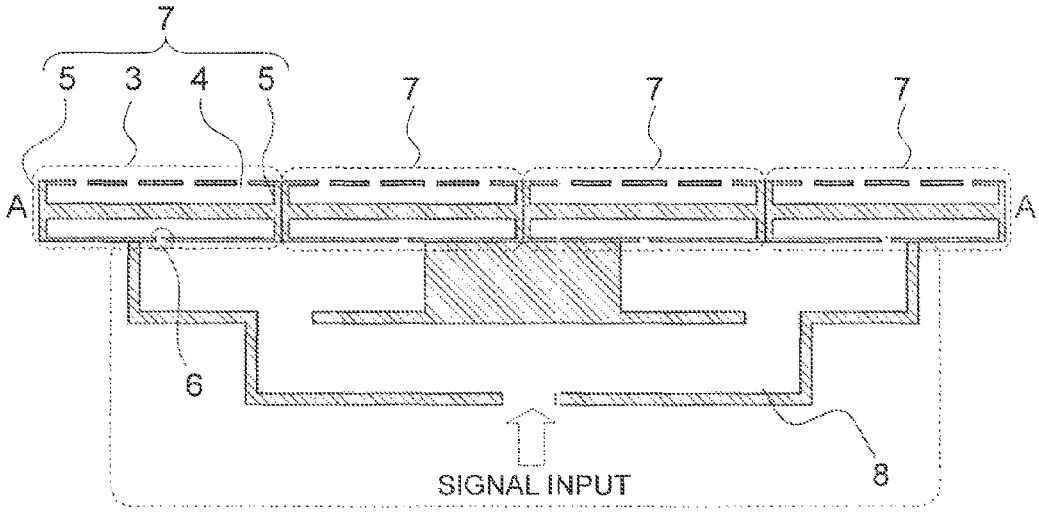
FIG. 2 is a cross-sectional view taken along A-A of FIG. 1.

FIG. 2 is a cross-sectional view taken along A-A of FIG. 1. As illustrated in FIG. 2, both end surfaces of the coaxial line 3 are short-circuited by a short-circuit plate 5, and a coupling hole 6 is provided in the coaxial line 3 to be fed by feeding means (a waveguide is assumed here). A coaxial line slot array antenna per unit is formed of the coaxial line 3, the slots 4, the short-circuit plates 5, and the coupling hole 6 for feeding connected to the feeding means. Hereinafter, this is called a sub-array 7. As described above, a feed circuit 8 serving as the feeding means, which is formed of the waveguide, is provided below the respective sub-arrays 7, and the coupling holes 6 are provided in narrow wall surfaces thereof. A plurality of the sub-arrays 7 are arranged on a plane as illustrated in FIG. 1 to form a two-dimensional antenna.

Next, an operation is described on the assumption of a transmission system. A signal input to the feed circuit 8 is equally distributed in the circuit to propagate below the sub-arrays 7, and is transmitted to the coaxial line slot arrays (sub-arrays) 7 through the coupling holes 6 by electromagnetic coupling. Then, the signal propagates through the coaxial lines 3 to be emitted from the slots 4. In this case, the respective slots 4 of the sub-array 7 are uniformly excited. Further, the respective sub-arrays 7 (for one row) connected to the feed circuit 8 are also uniformly excited. Moreover, feeding is also uniformly performed between the sub-array rows 7 which are horizontally adjacent to each other (see FIG. 1) by feeding means (not shown) formed at a lower stage of the feed circuit 8. Accordingly, in the planar array antenna illustrated in FIG. 1, all the slots 4 which are elements thereof are excited with equal amplitude and equal phase, with the result that high-gain radiation characteristics can be obtained.

Here, the principle of uniformly exciting the respective slots 4 in one sub-array is described below. Both ends of the coaxial line 3 are short-circuited by the short-circuit plate 5, and a length of the coaxial line 3 is set so that a standing wave propagates through the waveguide with a frequency to be used. A TEM wave propagates as a basic mode through the coaxial line 3, and hence its guide wavelength $\lambda g$ is equal to a free-space wavelength $\lambda_0$. For this reason, the length of the coaxial line 3 is substantially an integral multiple of the wavelength $\lambda_0$. A length of the slot 4 is substantially a resonance length of $\lambda_0/2$. Slot positions of ends on both sides of the sub-array are each apart from the short-circuit plate 5 substantially by $A_0/2$, and other slots are arranged so that adjacent slot interval is substantially $\lambda_0$.

Figure 3:
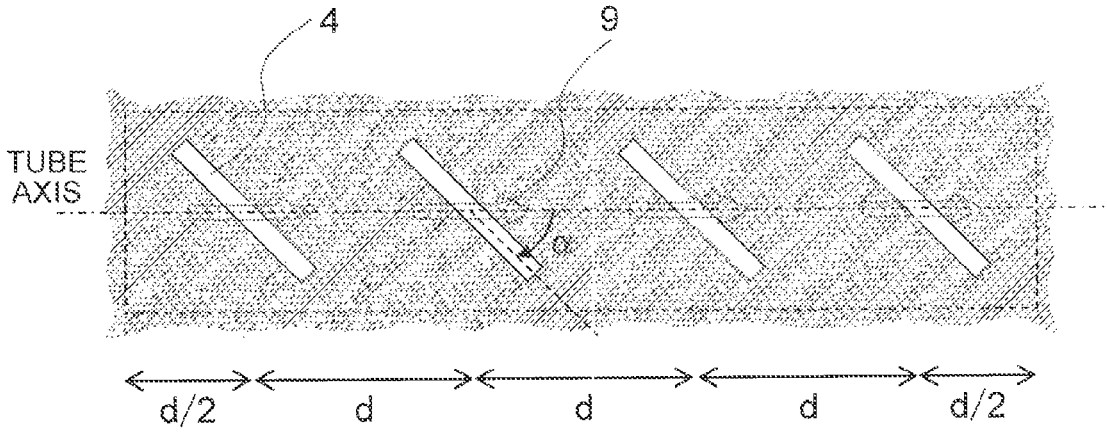
FIG. 3 is a view illustrating an arrangement example of a plurality of slots arranged in a tube axis direction of a coaxial line.

FIG. 3 illustrates an arrangement example thereof. In FIG. 3, reference numeral 9 denotes a direction of a current flowing at a position of an antinode of the standing wave on the outer conductor 1. Further, a distance d between the slots is equal to the wavelength $\lambda_0$. Accordingly, the current becomes maximum at the position of the antinode of the standing wave, and when the slots 4 are arranged thereat, excitation is uniformly performed, whereby radiation can be efficiently performed.

Incidentally, as described above, the TEM wave propagates through the coaxial line 3. Restrictions are placed on an inner conductor diameter a and an outer conductor diameter b of the coaxial line 3 for propagating only the TEM wave and not for generating other higher-order mode. When a wavelength at a cut-off frequency is $\lambda c$, the following relationship is established:

$$\lambda c \approx \pi(a+b) \tag{1}$$

By using an electromagnetic wave having a longer wavelength than $\lambda c$, only the TEM wave can propagate.

In other words, ideally, an electromagnetic wave having a sufficiently longer wavelength than a size of a or b can also propagate, and hence a size of the coaxial line 3 can be set to be sufficiently smaller compared with a wavelength of a frequency to be used. As can be seen from the above, there is an advantage that the slot arrays can be arranged so as to be adjacent to each other at narrower intervals compared with a waveguide slot array antenna, enabling beam scanning in a wider angle range.

Further, the coaxial line 3 has a feature of lower-loss compared with other line such as a microstrip line or a suspended line. In addition, depending on a metal material for manufacturing, there can also be obtained a characteristic comparable to a loss occurring in the waveguide.

Further, the case where the waveguide is used as the feeding means for the coaxial line slot array is described here, but the feeding may be performed by the coaxial line. In this case, antenna height can be kept to be lower compared with the case of the waveguide (case where feeding to the coaxial line 3 is performed through the coupling hole 6 provided on the narrow wall surface of the waveguide, and hence the waveguide is arranged to be erect). Further, in this case, a shape of the coupling hole is different from that in the case of the waveguide.

As illustrated in FIG. 3, the slots 4 are formed by being turned at an angle $\alpha$ with respect to a tube axis on an appropriate side surface parallel to a tube axis direction of the coaxial line 3. In consideration of the direction 9 of the current, there is a limitation on an angle range to be more than 0 degrees and smaller than 180 degrees. When $\alpha=0$ (or 180 degrees), the slots 4 are not excited. It should be noted that a polarized wave can be changed through adjustment of this angle $\alpha$.

Figure 4:
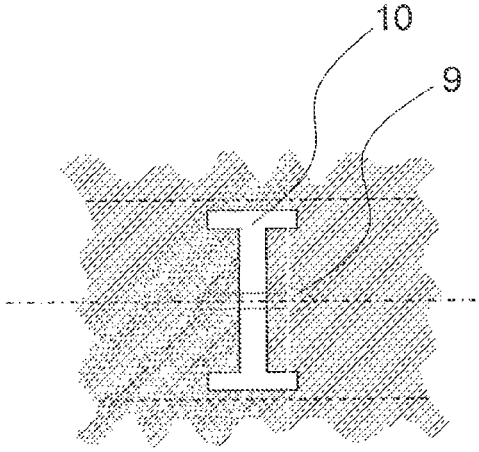
FIG. 4 is an explanatory view of a slot having both ends formed in T-junction.
Figure 5:
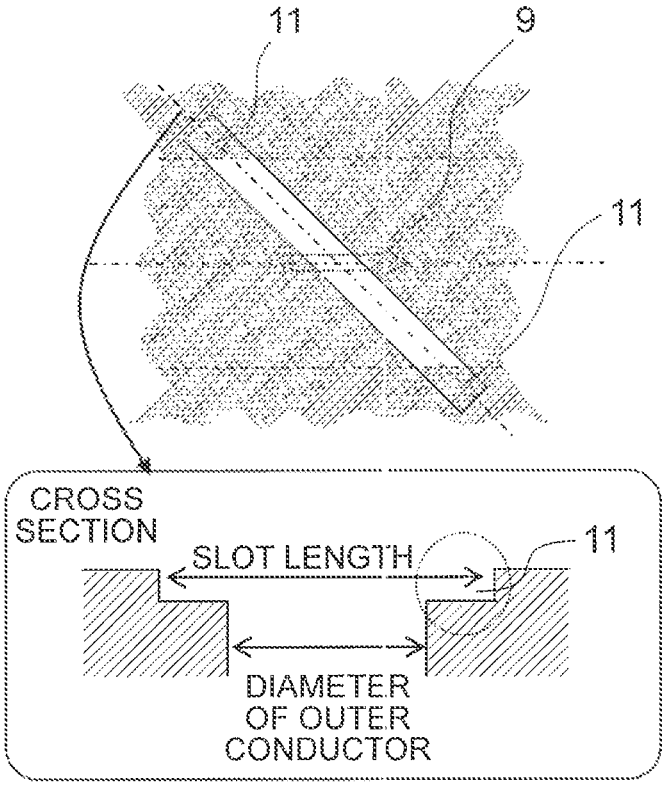
FIG. 5 is an explanatory view of a slot having a slot outer shape (side surface) formed at slot ends protruding from an outer conductor.

FIG. 4 and FIG. 5 illustrate cases where the shapes of the slots 4 are different from each other. FIG. 4 illustrates a slot 10 having both ends formed in T-junction, and FIG. 5 illustrates a slot in which slot ends 11 protruding from the outer conductor 1 have a slot outer shape (side surface). As described above, the diameter of the outer conductor of the coaxial line is set to be small with respect to the wavelength for enlarging a beam scanning area, and hence it is difficult to set the slot to have approximately a resonance length.

Then, in the slot 10 of FIG. 4, the both ends thereof are formed in T-junction, whereby a resonance length can be satisfied without generating a cross-polarization component. This is because the T-junction portions are parallel to the direction of the current.

On the other hand, in FIG. 5, the slot is arranged by being turned with respect to the tube axis, and thus there is a fear that, when the T-junctions are provided as in the case of the slot 10, the T-junctions are not parallel to the direction of the current, to thereby generate the cross-polarization component.

Then, a slot having a resonance length is carved in the conductor surface provided with the slots to form side surfaces thereof, but the ends 11 protruding from the diameter of the outer conductor has the structure in which the slot hole is blocked. As a result, though a length of the slot portion having a hole provided on the outer conductor does not satisfy the resonance length, the slot outer shape of that portion is formed. Therefore, there is an advantage that the characteristic of the slot itself, which corresponds to that of being resonated, can be obtained.

In the planar array antenna, depending on its use, a low sidelobe should be achieved in some cases. In this case, a desired aperture distribution needs to be realized in the slot array.

Figure 6:
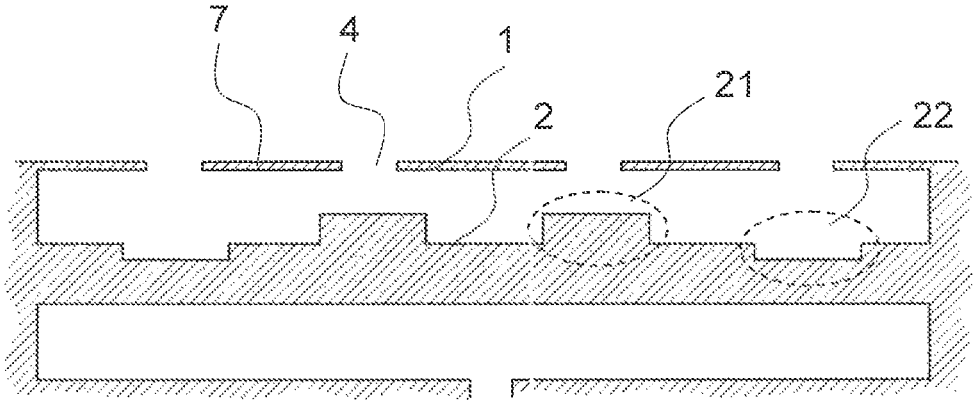
FIG. 6 is a cross-sectional view of one sub-array including a convex portion and a concave portion provided in an inner conductor on a slot side.

FIG. 6 illustrates a cross-section of one sub-array 7. As illustrated in FIG. 6, a convex portion 21 and a concave portion 22 are provided in the inner conductor 2 on the slot 4 side. In the coaxial line 3, a potential is generated between the inner conductor 2 and the outer conductor 1. When this potential is changed, an electromagnetic coupling state to the slot 4 is changed, which changes an excitation amplitude of the slot 4.

For this reason, the convex portion 21 and the concave portion 22 are provided on the slot 4 side of the inner conductor 2 to adjust the diameter of the inner conductor 2, that is, the diameter of the inner conductor 2 is adjusted so that an interval between the outer conductor 1 and the inner conductor 2, in which the slot 4 is provided, differs for each slot 4, whereby the excitation amplitude of the slot 4 is adjusted to achieve an effect that the aperture distribution for obtaining the desired low sidelobe level can be realized.

It should be noted that electromagnetic coupling to the slot is enhanced in the convex portion 21, which increases the excitation amplitude. On the other hand, the concave portion 22 is the opposite. In FIG. 6, one convex portion 21 or one concave portion 22 corresponds to one slot 4, which is not limited thereto. There arises no problem in the structure including a plurality of the convex portions and the concave portions as long as a coupling amount to the slot 4 can be adjusted.

Figure 7:
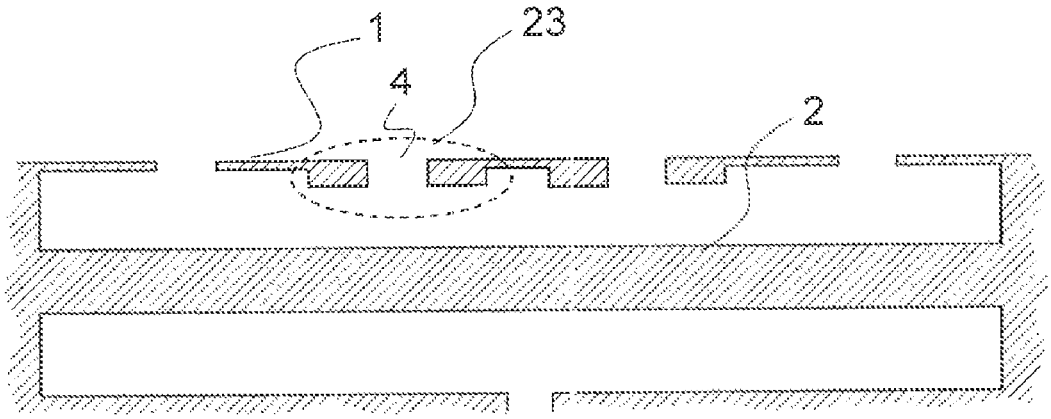
FIG. 7 is a cross-sectional view of one sub-array including a convex portion in the outer conductor in the vicinity of the slot.

FIG. 7 illustrates a cross-section of one sub-array 7. In FIG. 7, a convex portion 23 is provided in the outer conductor 1 located in the vicinity of the slot 4. In other words, an inner diameter of the outer diameter 1 is adjusted so that the interval between the outer conductor 1 and the inner conductor 2, in which the slot 4 is provided, differs for each slot 4, and the potential between the inner conductor 2 and the outer conductor 1 is changed in the similar manner to the above, to thereby adjust the excitation amplitude and phase of the slot. Coupling is enhanced to the slot located in the vicinity of the convex portion 23 of the outer conductor. It should be noted that the shape of the convex portion 23 is not limited thereto and may be appropriately changed to obtain a desired coupling amount to the slot.

A guide wavelength of the coaxial line is the same as a free-space wavelength, and hence the slots arranged along the tube axis are arranged at $\lambda_0$ interval in the above for realizing a uniform aperture distribution through standing wave excitation. In this case, in a cut plane including the tube axis and a zenith direction, grating lobes are generated in +90 degree direction thereto, which causes a decrease in gain. Therefore, it is necessary to make the guide wavelength shorter than the free-space wavelength to make an arrangement interval of the slots smaller than $\lambda_0$.

Figure 8:
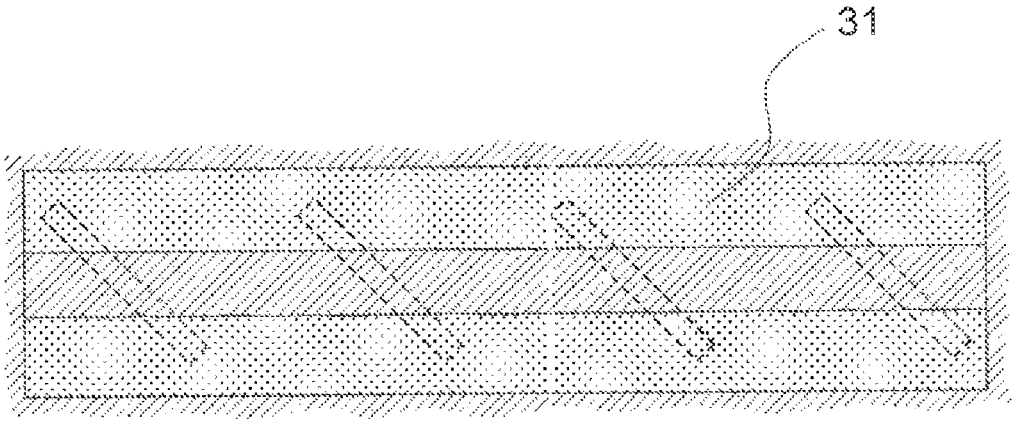
FIG. 8 is a view illustrating a coaxial line slot array in which the coaxial line is filled with a dielectric material.

FIG. 8 illustrates a coaxial line slot array in which a coaxial line is filled with a dielectric material 31. In FIG. 8, a hatched portion of 31 is a dielectric material filled between the inner conductor and the outer conductor of the coaxial line. When the dielectric material 31 is filled between the inner conductor and the outer conductor of the coaxial line, there is an effect that the guide wavelength is shortened due to a specific dielectric constant of the dielectric material 31. Accordingly, there is a feature that the slot interval can be made smaller than $\lambda_0$ as described above to suppress generation of the grating lobe.

Figure 9:
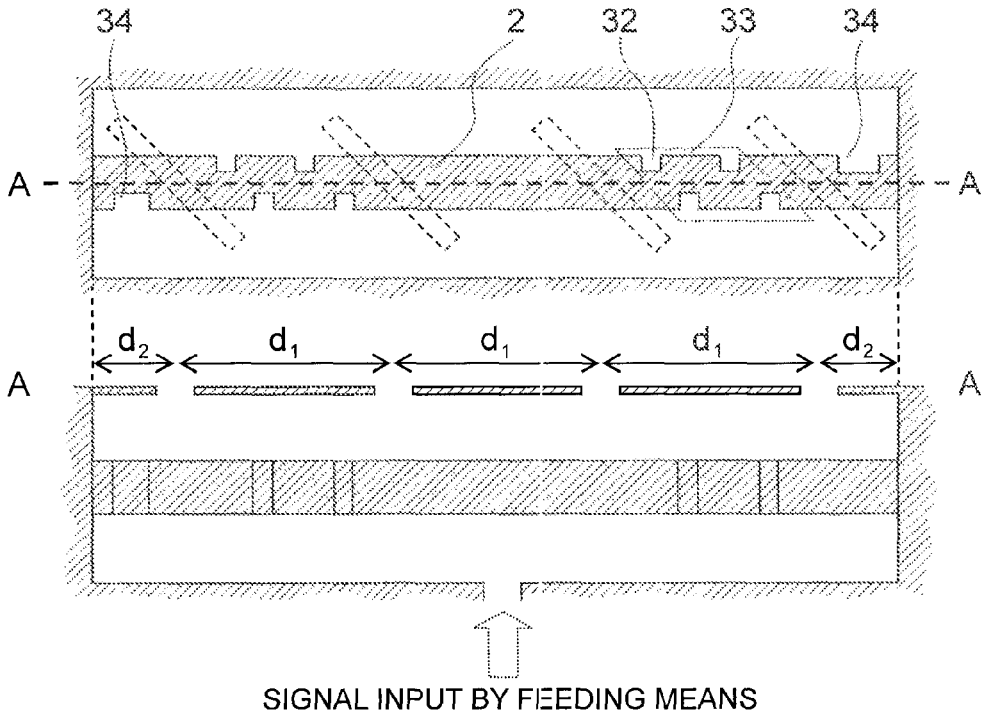
FIG. 9 is a cross-sectional view of one sub-array in which the inner conductor is formed in a meandering shape so as to shorten a guide wavelength of the coaxial line by a method different from filling the dielectric material.

FIG. 9 illustrates a shape of the inner conductor 2 capable of obtaining the effect of shortening the coaxial line guide wavelength by a method different from filling the dielectric material. As illustrated in FIG. 9, concave portions 32 are provided on the inner conductor 2, and an aggregate 33 of the concave portions 32 has a zigzag structure. Further, concave portions 34 are provided in the vicinity of ends of the inner conductor 2.

Unlike the concave portion 22 illustrated in FIG. 6, the concave portion 32 and the concave portion 34 are provided not on a surface of the inner conductor, which faces the slot, but on both side surfaces thereof orthogonal thereto. This is for preventing also the coupling amount to the slot from changing by forming the concave portion 32 and the concave portion 34 on the surface of the inner conductor 2. Further, the concave portion 32 and the concave portion 34 are provided at positions deviated from under the slots for the similar reason.

When the inner conductor 2 between the slots (distance d1) has the zigzag structure 33 with a plurality of the concave portions 32, that is, when the inner conductor 2 is formed in a meandering shape, there is achieved an effect of shortening the guide wavelength. Accordingly, when this is applied, there is a feature that the slot interval can be made smaller than $\lambda_0$ to suppress the generation of the grating lobe.

Further, in order to excite the coaxial line slot array by a standing wave, an interval $d_2$ between the slot formed at an end thereof and the short-circuit plate needs to be smaller than $\lambda_0/2$. Accordingly, for example, the concave portion 34 or the like is provided. Moreover, the concave portions may be provided on an entire surface of the inner conductor. In other words, the diameter of the inner conductor may be made small in one part thereof.

It should be noted that the zigzag structure 33 is not formed in a center of the inner conductor 2 facing the slots. This is because feeding to the coaxial line by the feeding means (not shown) is performed in a center of the inner conductor 2, and hence there is no need to shorten the guide wavelength as long as the slot interval is set to $d_1$. As to the zigzag structure, the number of concave portions or the shape of the concave portion itself can be appropriately set depending on a wavelength shortening amount. Naturally, a curve structure may be provided.

In addition, it has been described that the zigzag structure 33 is formed on the side surface of the inner conductor, which is orthogonal to the surface facing the slots, but there arises no problem as long as the zigzag structure 33 is formed on the surface facing the slots to shorten the guide wavelength while adjusting a coupling amount to the slots.

Figure 10:
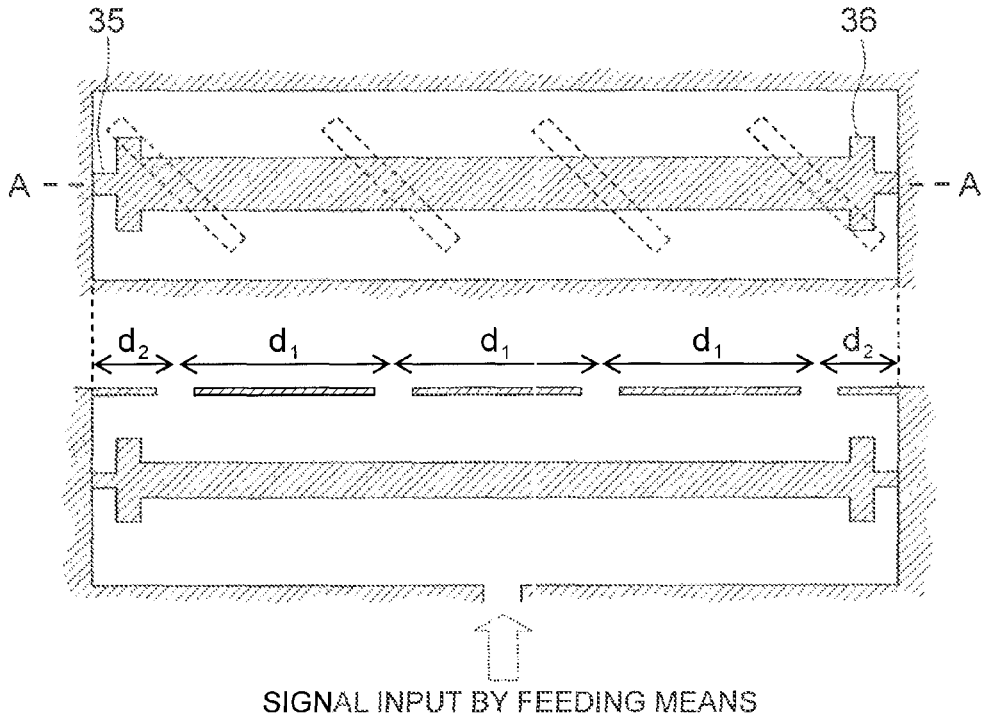
FIG. 10 is a view illustrating a structure for obtaining an effect of shortening the guide wavelength of a distal short-circuited portion of the coaxial line.

FIG. 10 illustrates a structure capable of obtaining an effect of shortening the guide wavelength of a distal short-circuited portion of the coaxial line. In FIG. 10, reference numerals 35 and 36 denote an inner conductor having a smaller diameter and an inner conductor having a larger diameter, respectively, compared with the diameter of the inner conductor located in portions other than the distal short-circuited portions (here, referred to as base line portion). A characteristic impedance of the coaxial line is proportional by b/a, and hence with respect to a characteristic impedance value of the base line portion, the inner conductor 35 having a smaller diameter shows a higher characteristic impedance value, while the inner conductor 36 having a larger diameter shows a lower characteristic impedance value. As with this structure, the guide wavelength can also be shortened by connecting a high-impedance line and a low-impedance line in an order starting from the distal short-circuited portion. It should be noted that, in FIG. 10, the diameters of the inner conductors are simultaneously made small/large on the inner conductor surface side facing the slots or a signal input side (thickness direction of the inner conductor) and the both surface sides orthogonal thereto (width direction of the inner conductor). However, the similar effect can also be obtained by making the size of the inner conductor only in the thickness direction thereof or the size of the inner conductor only in the width direction thereof small/large.

In the first embodiment, the coaxial line slot array (sub-array) 7 is used not only for the planar array illustrated in FIG. 1 in which the plurality of sub-arrays 7 are provided, but can also be used as the sub-array itself, depending on its use. In this case, the coaxial line is not limited to have a square shape, and, for example, may have a circular shape.

Second Embodiment

In the first embodiment described above, the description has been given of the structure of the coaxial line slot array antenna excited by the standing wave. Next, a method of manufacturing this antenna is described.

Figure 11:
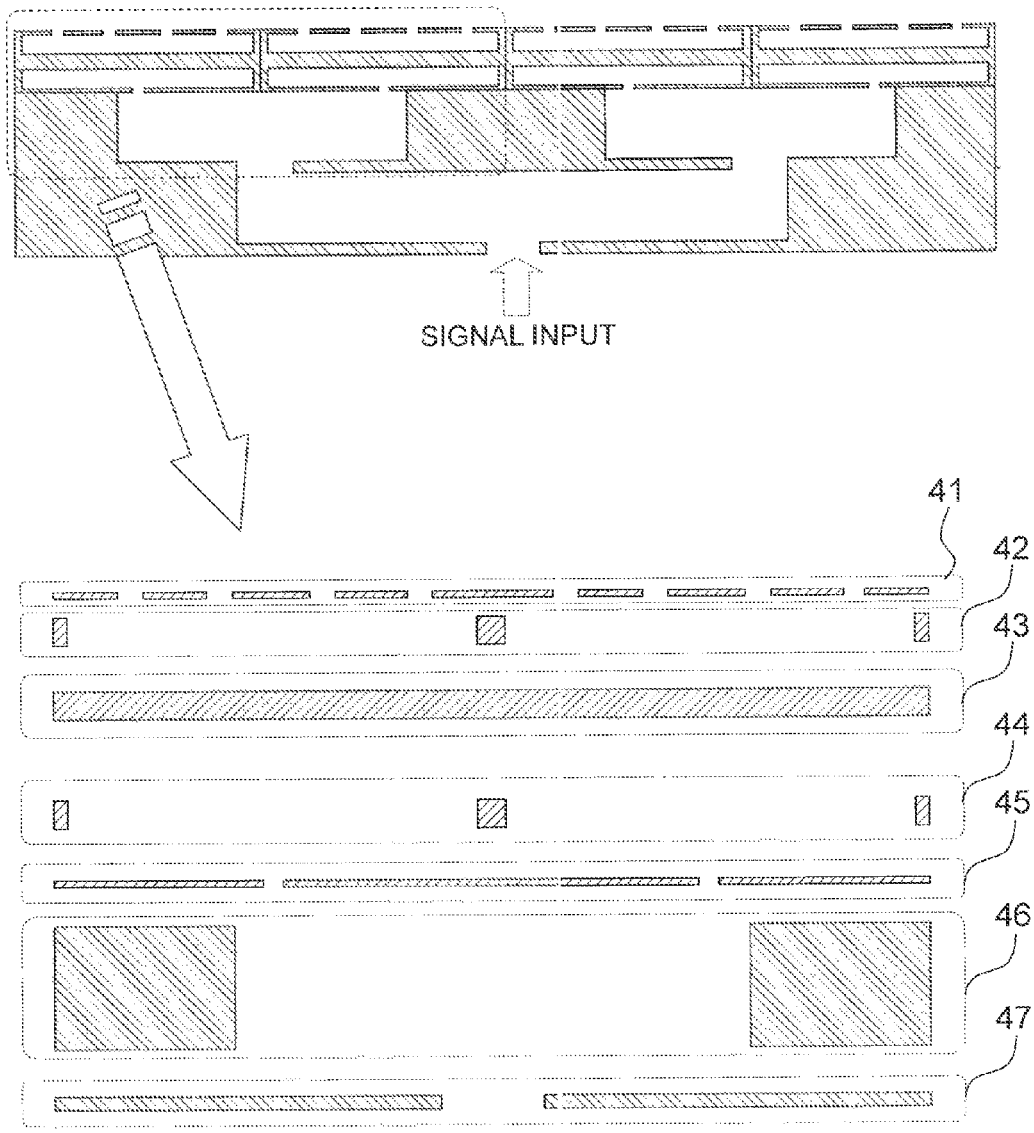
FIG. 11 are a cross-sectional view for illustrating a method of manufacturing a coaxial line slot array antenna according to a second embodiment of the present invention and an exploded cross-sectional view of a part of the antenna.

FIG. 11 are a cross-sectional view for illustrating a method of manufacturing a coaxial line slot array antenna according to a second embodiment of the present invention and an exploded cross-sectional view of a part of the antenna. Here, a waveguide is used as a feeding technique for the coaxial line.

In the exploded cross-sectional view of FIG. 11, respective portions are divided and sliced into a plate shape so as to parallel to the tube axis of the square coaxial line and also parallel to the side surface of the outer conductor in which the slots are provided, and are formed by a step of individually cutting seven metal conductor plates. For simplification of explanation, only two sub-arrays within one row are illustrated in the figure. Through a step of laminating a plurality of metal conductor plates including the respective portions formed therein together by contact bonding, the coaxial line slot array antenna is manufactured.

That is, as illustrated in FIG. 11, as the plates including the respective portions formed therein by individually cutting the seven metal conductor plates, there are provided a slot surface plate 41, a first coaxial line plate 42, an inner conductor plate 43, a second coaxial line plate 44, a coupling hole plate 45, a first feeding waveguide plate 46, and a second feeding waveguide plate 47.

Here, there is provided a structure of being divided and sliced into the seven plate parts as illustrated in the figure. For this reason, a plate thickness differs in the respective parts. The slot surface plate 41 is a part forming the outer conductor surface with the slots, and is manufactured by cutting slot portions from the metal conductor plate. The first and second coaxial line plates 42 and 44 are parts forming the short-circuit plates of the coaxial line ends and a side surface of the outer conductor, and are manufactured by cutting a space between the inner conductor and the outer conductor from the metal conductor plate.

The inner conductor plate 43 is a part forming the inner conductor and the side surface of the outer conductor, and is manufactured by cutting the space between the inner conductor and the outer conductor from the metal conductor plate. The coupling hole plate 45 is a part forming a bottom surface of the outer conductor and the coupling hole, and is manufactured by cutting a coupling portion from the metal conductor plate. The first and second feeding waveguide plates 46 and 47 are parts forming a part of the feeding waveguide together, and are manufactured by cuffing a waveguide portion from the metal conductor plate. Those plates are laminated together through contact bonding, whereby the coaxial line slot array antenna and the feed circuit for feeding the coaxial line slot array antenna can be integrally formed.

Figure 12:
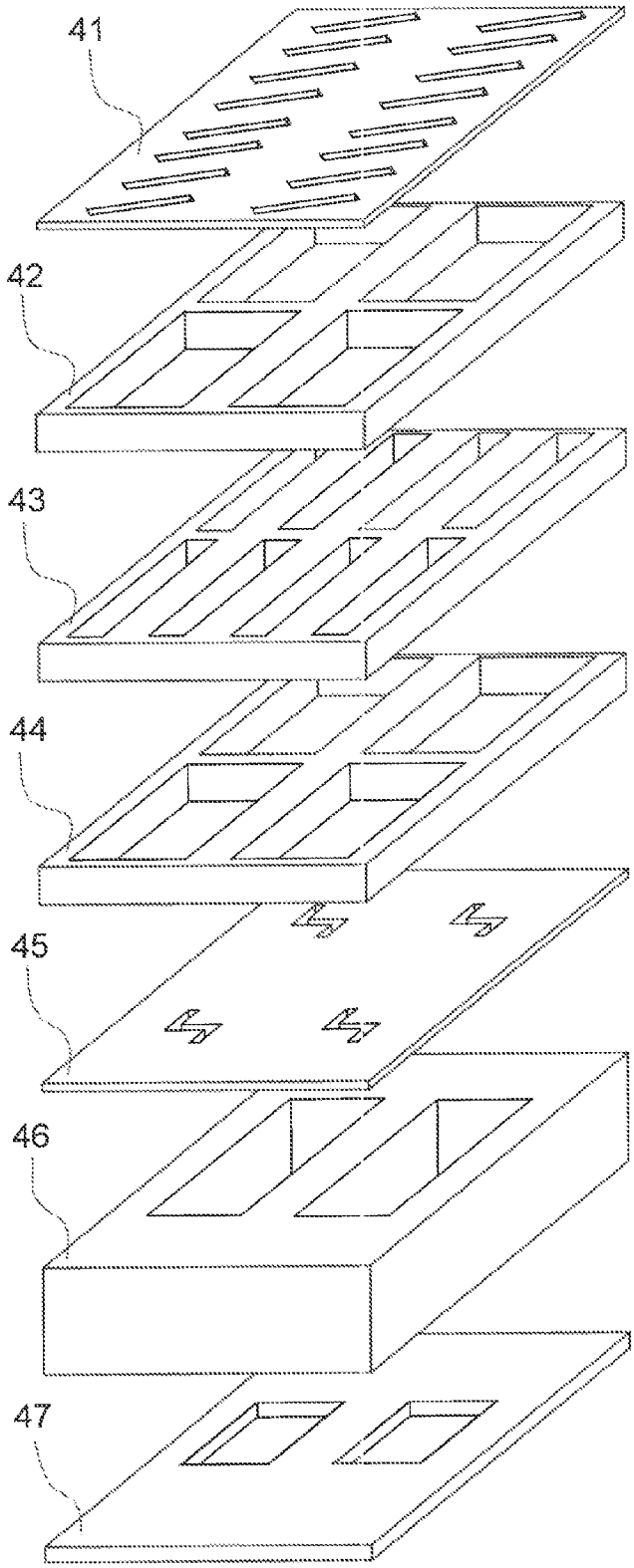
FIG. 12 is a schematic view illustrating the exploded cross-sectional view of FIG. 11 in three dimensions.

FIG. 12 is a schematic view illustrating the exploded cross-sectional view of FIG. 11 in three dimensions. The size of the coaxial line and the size of the waveguide are illustrated with exaggeration, and hence it should be noted that they are different from the sizes when being actually manufactured. As the feeding means for the coaxial line slot array, the waveguide is disposed to be erect so that the narrow wall surface of the waveguide and the coaxial line are brought into contact with each other, whereby the plate 46 serving as the waveguide portion becomes thick. Naturally, when this plate 46 is further divided and sliced into a plurality of plates to increase the number of the plates, there arises no problem because lamination is performed collectively.

The zigzag structure of the inner conductor as the means for shortening the guide wavelength, which has been described in the first embodiment, has the advantage of being cutting and processing with the plate 43. The concave portion and the convex portion for adjusting a coupling amount to the slot can also be cut and processed.

As a method of contact bonding and laminating, there are diffusion bonding, thermocompression bonding, and the like. When performing contact bonding, it is difficult to uniformly apply pressure over an entire surface of the plate. However, in the case of the square coaxial line, the inner conductor is connected only to the short-circuit plates at the both ends of the coaxial line and is disposed in a state of substantially floating in approximately a center of the outer conductor, and hence the square coaxial line has an advantage of accommodating to unevenness in pressure.

The invention claimed is:

1. A coaxial line slot array antenna, comprising:

a coaxial line including an inner conductor, an outer conductor provided so as to surround a circumference of the inner conductor, and both ends short-circuited;

feeding means for exciting the coaxial line; and a plurality of slots which are formed on the outer conductor with a certain angle with respect to a tube axis direction of the coaxial line and have approximately a resonance length, wherein in a state where the coaxial line is excited by the feeding means to generate a standing wave in the coaxial line, the plurality of slots arranged in the tube axis direction are set to have intervals therebetween of substantially one wavelength in free space, and an interval between one short-circuited end of the coaxial line forming a single sub-array and the slot formed at the short-circuited end is set to be substantially a half-wavelength in the free space.

2. A coaxial line slot array antenna according to claim 1, wherein:

the coaxial line comprises a square coaxial line;

the plurality of slots are formed in one appropriate side surface of the outer conductor, which is parallel to the tube axis direction of the square coaxial line; and the square coaxial line, the feeding means, and the plurality of slots form a single sub-array, and a plurality of the sub-arrays are arranged on a plane to form a two-dimensional array antenna.

3. A coaxial line slot array antenna according to claim 2, wherein, in the state where the square coaxial line is excited by the feeding means to generate a standing wave in the square coaxial line, the plurality of slots arranged in the tube axis direction are set to have the intervals therebetween of one wavelength in free space, and the interval between the short-circuited end of the square coaxial line forming the sub-array and the slot formed at the short-circuited end is set to be a half-wavelength in the free space.

4. A coaxial line slot array antenna according to claim 2, wherein a diameter of the inner conductor is adjusted so that an interval between the outer conductor and the inner conductor at a position where one of the plurality of slots is formed differs for each of the plurality of slots.

5. A coaxial line slot array antenna according to claim 2, wherein an inner diameter of the outer conductor is adjusted so that an interval between the outer conductor and the inner conductor at a position where one of the plurality of slots is formed differs for each of the plurality of slots.

6. A coaxial line slot array antenna according to claim 2, wherein the coaxial line is filled with a dielectric material.

7. A coaxial line slot array antenna according to claim 2, wherein a part of the inner conductor disposed between the plurality of slots is formed in a meandering shape.

8. A coaxial line slot array antenna according to claim 2, wherein the plurality of slots each have both ends formed in T-junction.

9. A coaxial line slot array antenna according to claim 2, wherein the plurality of slots each have a slot length longer than a diameter of the outer conductor and have a slot outer shape at an end thereof, which protrudes from the outer conductor.

10. A coaxial line slot array antenna according to claim 2, wherein a diameter of the inner conductor between short-circuited portions at the both ends of the coaxial line and the plurality of slots adjacent to the short-circuited portions is small diameter, then large diameter in an order starting from the distal short-circuited portion to a diameter of the inner conductor at portions other than the short-circuited portions.

11. A coaxial line slot array antenna according to claim 1, wherein each of the plurality of slots are formed on the outer conductor at the same certain angle, the same certain angle being greater than 0 and less than 180 degrees.

12. A method of manufacturing a coaxial line slot array antenna, the coaxial line slot array antenna being formed by:

a square coaxial line including an inner conductor, an outer conductor provided so as to surround a circumference of the inner conductor, and both ends short-circuited;

a plurality of slots formed in an appropriate side surface of the outer conductor, which is parallel to a tube axis direction of the square coaxial line; and feeding means for exciting the square coaxial line, the square coaxial line, the plurality of slots, and the feeding means forming a single sub-array, a plurality of the sub-arrays being arranged on a plane to form a two-dimensional array antenna, the method comprising:

individually cutting a plurality of metal conductor plates including respective plate-like portions divided and sliced so as to be parallel to the tube axis direction of the square coaxial line and also parallel to the side surface of the outer conductor including the plurality of slots formed therein; and laminating the plurality of metal conductor plates in which the respective portions are cut by contact bonding.

* * * * *